US012152580B2

(12) United States Patent
Yoshida et al.

(10) Patent No.: US 12,152,580 B2
(45) Date of Patent: Nov. 26, 2024

(54) HYDRAULIC PUMP

(71) Applicant: KAWASAKI JUKOGYO KABUSHIKI KAISHA, Kobe (JP)

(72) Inventors: Takeshi Yoshida, Kobe (JP); Hidetoshi Miura, Kobe (JP); Yasunori Hirano, Kobe (JP); Yuta Makino, Kobe (JP); Yuya Hyodo, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 125 days.

(21) Appl. No.: 18/028,853

(22) PCT Filed: Sep. 28, 2021

(86) PCT No.: PCT/JP2021/035492
§ 371 (c)(1),
(2) Date: Mar. 28, 2023

(87) PCT Pub. No.: WO2022/065501
PCT Pub. Date: Mar. 31, 2022

(65) Prior Publication Data

US 2023/0332594 A1 Oct. 19, 2023

(30) Foreign Application Priority Data

Sep. 28, 2020 (JP) ..... 2020-162500

(51) Int. Cl.
*F04B 1/2014* (2020.01)
*F04B 11/00* (2006.01)
*F04B 53/00* (2006.01)

(52) U.S. Cl.
CPC ..... *F04B 53/004* (2013.01); *F04B 1/2014* (2013.01); *F04B 11/0091* (2013.01)

(58) Field of Classification Search
CPC .. F04B 1/20–24; F04B 11/00; F04B 11/0091; F04B 53/001
See application file for complete search history.

(56) References Cited

U.S. PATENT DOCUMENTS 6,024,541 A * 2/2000 Perstnev ..... F04B 1/2042 91/487
6,086,336 A 7/2000 Welschof et al.
(Continued)

FOREIGN PATENT DOCUMENTS

JP S63-202774 U 12/1988
JP H03-85381 A 4/1991
(Continued)

*Primary Examiner* — Thomas Fink
(74) *Attorney, Agent, or Firm* — Oliff PLC

(57) ABSTRACT

A hydraulic pump includes: a valve plate including a suction port and a delivery port; a valve cover to which the valve plate is mounted; and a cylinder block that slides on the valve plate. The valve cover includes a suction passage and a delivery passage. The valve cover includes: a first chamber that communicates with the delivery passage through a communication passage and functions as a Helmholtz resonator; and a second chamber that communicates with the delivery passage, or with the first chamber, through an introduction passage including a restrictor. In the valve cover and the valve plate, a supply passage extends from the second chamber to a bottom dead center-side sealing surface of the valve plate, the bottom dead center-side sealing surface being a surface located between the suction port and the delivery port. The supply passage includes a restrictor.

9 Claims, 3 Drawing Sheets

(56) References Cited

U.S. PATENT DOCUMENTS

| | | | | |
|---|---|---|---|---|
| 6,186,748 | B1 * | 2/2001 | Umeda | F04B 1/2042 417/269 |
| 2008/0138225 | A1 | 6/2008 | Shinohara et al. | |

FOREIGN PATENT DOCUMENTS

| | | | | |
|---|---|---|---|---|
| JP | H10-231778 | A | | 9/1998 |
| JP | 2000-97147 | A | | 4/2000 |
| JP | 2004251264 | A | * | 9/2004 |
| JP | 2011-236847 | A | | 11/2011 |
| WO | 2006/085547 | A1 | | 8/2006 |

* cited by examiner

HYDRAULIC PUMP

CROSS-REFERENCE TO RELATED APPLICATIONS

This is a U.S. National Phase Application of PCT/JP2021/035492 filed on Sep. 28, 2021, which designates the United States and claims priority to Japanese Patent Application No. 2020-162500 filed on Sep. 28, 2020, the entire contents of which are incorporated herein by reference.

TECHNICAL FIELD

The present disclosure relates to a hydraulic pump that is an axial piston pump.

BACKGROUND ART

Conventionally, there is a known hydraulic pump that is an axial piston pump. The hydraulic pump includes a valve plate and a cylinder block. The valve plate includes a suction port and a delivery port. The cylinder block slides on the valve plate. The cylinder block includes cylinder bores. The cylinder bores receive therein respective pistons.

In each cylinder bore, in a state where the cylinder bore is in communication with the suction port, the piston shifts in a direction away from the valve plate, and thereby suction is performed, whereas in a state where the cylinder bore is in communication with the delivery port, the piston shifts in a direction toward the valve plate, and thereby delivery is performed. A bottom dead center is the position of the piston in which the piston is farthest from the valve plate, whereas a top dead center is the position of the piston in which the piston is closest to the valve plate.

In a state where the cylinder bore is in communication with the suction port, the pressure of the cylinder bore is low. On the other hand, when the cylinder bore is brought into communication with the delivery port, the pressure of the cylinder bore becomes high. Accordingly, immediately after the cylinder bore is brought into communication with the delivery port (i.e., when the cylinder bore starts communicating with the delivery port), pulsation of delivery pressure occurs.

One method of reducing the pulsation of delivery pressure, which occurs when the cylinder bore starts communicating with the delivery port, is to introduce delivery pressure into the cylinder bore near the bottom dead center.

For example, Patent Literature 1 discloses a hydraulic pump in which a valve cover (referred to as a "case" in Patent Literature 1) to which a valve plate is mounted includes a suction passage and a delivery passage. The suction passage communicates with a suction port, and the delivery passage communicates with a delivery port. The delivery passage is connected to a chamber by a first communication passage. A second communication passage extends from the chamber to a bottom dead center-side sealing surface (referred to as a "sliding surface" in Patent Literature 1) of the valve plate between the suction port and the delivery port. An on-off valve is located on the first communication passage. The on-off valve opens/closes with, or more frequently than, a fundamental frequency R [Hz] ($R=S\times N/60$, where S is the number of pistons and N is a pump rotation speed [rpm]). According to this configuration, after the cylinder bore ends communicating with the suction port and before the cylinder bore starts communicating with the delivery port, delivery pressure is introduced into the cylinder bore.

CITATION LIST

Patent Literature

PTL 1; Japanese Laid-Open Patent Application Publication No. H03-85381

SUMMARY OF INVENTION

Technical Problem

Incidentally, the pulsation of delivery pressure has a frequency corresponding to the rotation speed of the hydraulic pump. Accordingly, the pulsation of delivery pressure cannot be reduced over a wide rotation speed range by merely introducing delivery pressure into the cylinder bore near the bottom dead center as in the hydraulic pump disclosed by Patent Literature 1.

In view of the above, an object of the present disclosure is to provide a hydraulic pump capable of reducing the pulsation of delivery pressure over a wide rotation speed range.

Solution to Problem

In order to solve the above-described problems, a hydraulic pump according to the present disclosure includes: a valve plate including a suction port and a delivery port; a valve cover to which the valve plate is mounted, the valve cover including a suction passage that communicates with the suction port and a delivery passage that communicates with the delivery port; and a cylinder block that slides on the valve plate, the cylinder block including cylinder bores that receive therein respective pistons. The valve cover includes: a first chamber that communicates with the delivery passage through a communication passage and functions as a Helmholtz resonator; and a second chamber that communicates with the delivery passage, or with the first chamber, through an introduction passage. In the valve cover and the valve plate, a supply passage extends from the second chamber to a bottom dead center-side sealing surface of the valve plate, the bottom dead center-side sealing surface being a surface located between the suction port and the delivery port.

According to the above configuration, delivery pressure is introduced into the second chamber in the valve cover through the introduction passage. Since the supply passage extends from the second chamber to the bottom dead center-side sealing surface, the delivery pressure can be introduced into the cylinder bore near the bottom dead center. By the second chamber thus configured, pulsation of delivery pressure at relatively low frequencies can be reduced. Moreover, since the valve cover includes the first chamber that functions as a Helmholtz resonator, pulsation of delivery pressure at relatively high frequencies can be reduced by the first chamber. Consequently, pulsation of delivery pressure can be reduced over a wide rotation speed range.

Advantageous Effects of Invention

The present disclosure makes it possible to reduce pulsation of delivery pressure over a wide rotation speed range.

DESCRIPTION OF EMBODIMENTS

Figure 1:
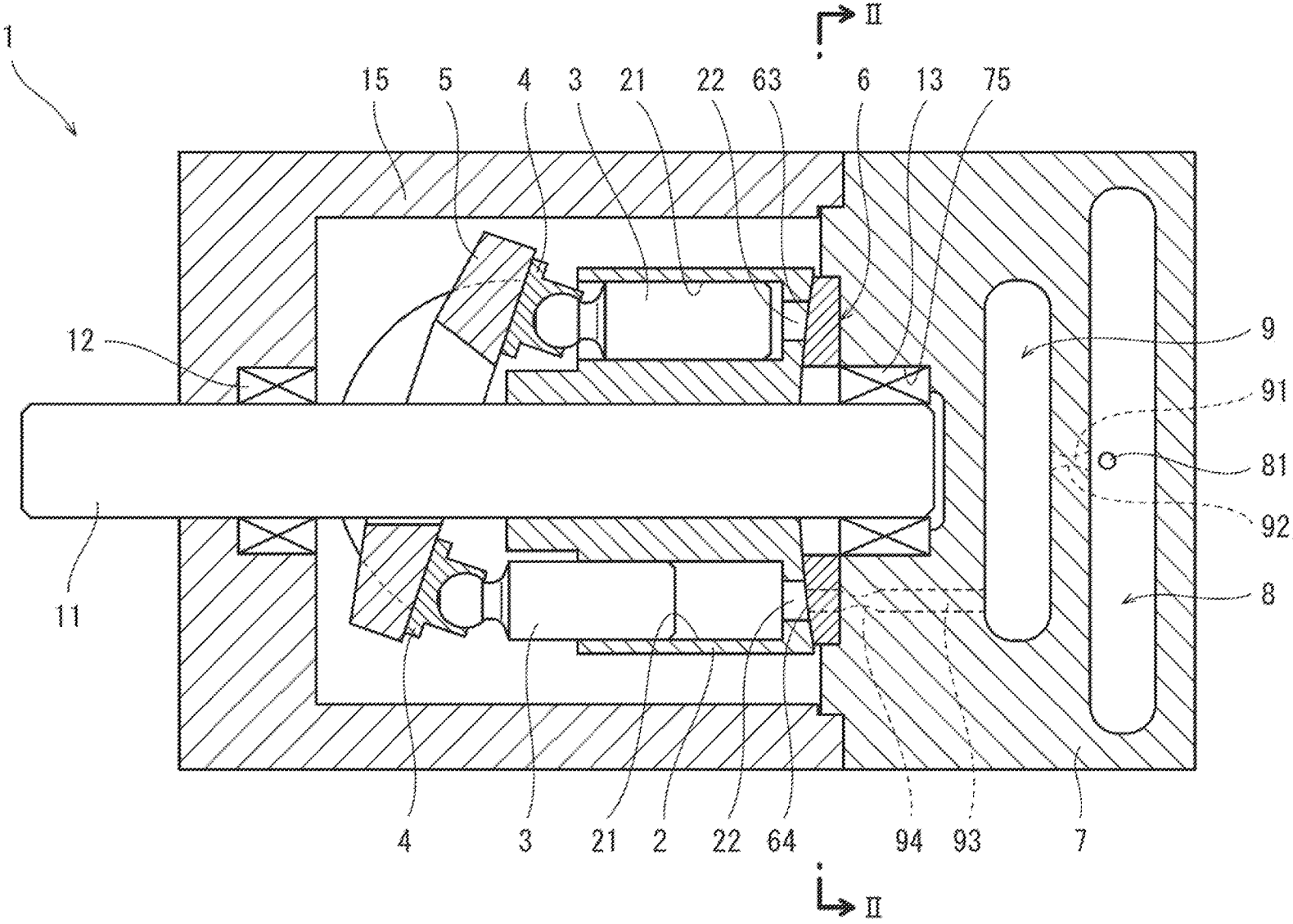
FIG. 1 is a longitudinal sectional view of a hydraulic pump according to one embodiment of the present disclosure.
Figure 2:
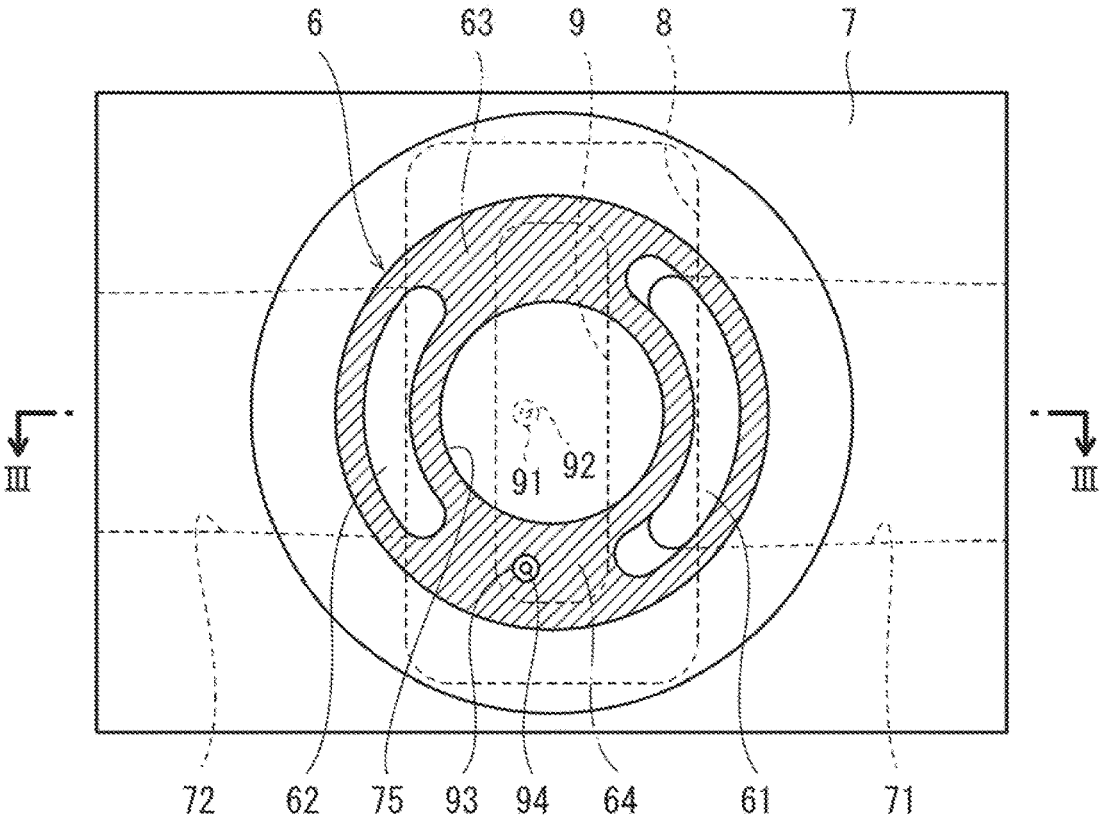
FIG. 2 is a cross-sectional view taken along line II-II of FIG. 1.
Figure 3:
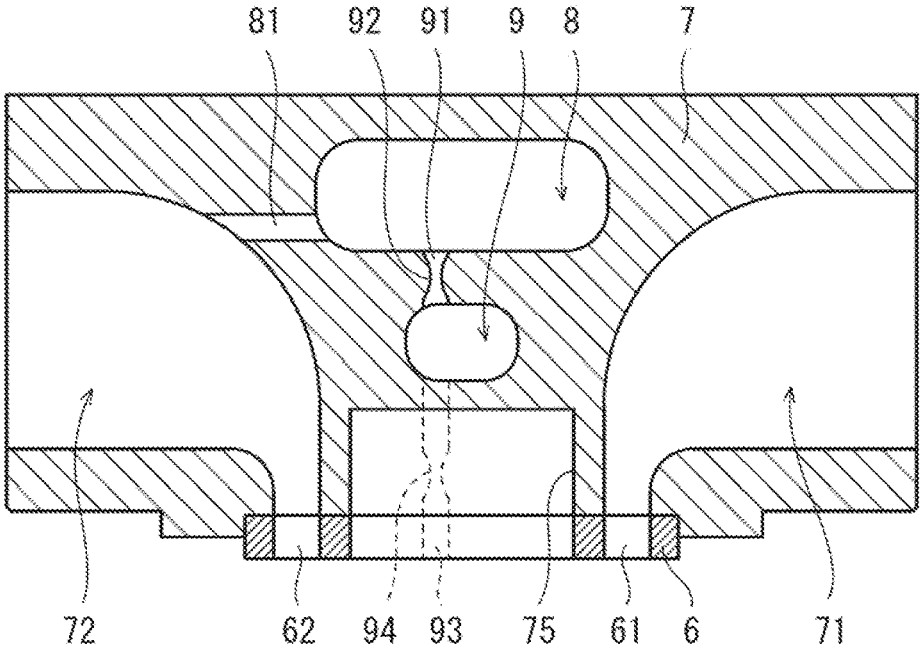
FIG. 3 is a sectional plan view taken along line III-III of FIG. 2.

FIGS. 1 to 3 show a hydraulic pump 1 according to one embodiment of the present disclosure. The hydraulic pump 1 is an axial piston pump. In the present embodiment, the hydraulic pump 1 is a swash plate pump. Alternatively, the hydraulic pump 1 may be a bent axis pump.

Specifically, the hydraulic pump 1 includes a rotational shaft 11, a container-shaped casing 15, and a valve cover 7. The casing 15 is penetrated by the rotational shaft 11. The valve cover 7 seals an opening of the casing 15. One end of the rotational shaft 11, the one end being positioned outside the casing 15, is coupled to an unshown prime mover (an engine or an electric motor). The rotational shaft 11 is rotated by the prime mover in one direction (in the present embodiment, in the clockwise direction in FIG. 2). In FIG. 2 and FIG. 3, for the purpose of simplifying the drawings, the illustration of the rotational shaft 11 and a below-described bearing 13 is omitted.

A bearing 12, which rotatably supports a middle portion of the rotational shaft 11, is held by the casing 15. The aforementioned bearing 13, which rotatably supports the other end of the rotational shaft 11, is held by the valve cover 7. Hereinafter, for the sake of convenience of the description, the axial direction of the rotational shaft 11 is referred to as the forward-backward direction (specifically, the direction toward the one end of the rotational shaft 11, the one end being coupled to the prime mover, is defined as forward, and the opposite direction toward the other end of the rotational shaft 11 is defined as backward).

A valve plate 6, a cylinder block 2, and a swash plate 5 are located in a space that is surrounded by the casing 15 and the valve cover 7. The valve plate 6, the cylinder block 2, and the swash plate 5 are penetrated by the rotational shaft 11.

The valve plate 6 is mounted to the front surface of the valve cover 7. As shown in FIG. 2, the valve plate 6 includes an arc-shaped suction port 61 and an arc-shaped delivery port 62. In the rotation direction of the rotational shaft 11, a surface of the valve plate 6, the surface being located downstream of the suction port 61 and upstream of the delivery port 62, is a bottom dead center-side sealing surface 64. In the rotation direction of the rotational shaft 11, a surface of the valve plate 6, the surface being located downstream of the delivery port 62 and upstream of the suction port 61, is a top dead center-side sealing surface 63. In other words, each of the bottom dead center-side sealing surface 64 and the top dead center-side sealing surface 63 is a surface located between the suction port 61 and the delivery port 62.

In the present embodiment, the length of the suction port 61 is greater than the length of the delivery port 62. Alternatively, the length of the suction port 61 and the length of the delivery port 62 may be the same. Although not illustrated, the top dead center-side sealing surface 63 may include a notch by which the suction port 61 is extended in a direction opposite the rotation direction of the rotational shaft 11, and the bottom dead center-side sealing surface 64 may include a notch by which the delivery port 62 is extended in the direction opposite the rotation direction of the rotational shaft 11. Alternatively, the suction port 61 and/or the delivery port 62 may be extended not by the notch, but by a different configuration (e.g., by a conduit hole).

The cylinder block 2 is fixed to the rotational shaft 11, and slides on the valve plate 6. The cylinder block 2 includes cylinder bores 21, which are open forward. These cylinder bores 21 receive therein respective pistons 3.

The cylinder block 2 further includes cylinder ports 22 for the respective cylinder bores 21. Each cylinder port 22 is intended for bringing the corresponding cylinder bore 21 into communication with the suction port 61 or the delivery port 62. In accordance with rotation of the rotational shaft 11, the state of each cylinder port 22 is switched in the following order: a state where the cylinder port 22 communicates with the suction port 61; a state where the cylinder port 22 is sealed by the bottom dead center-side sealing surface 64; a state where the cylinder port 22 communicates with the delivery port 62; and a state where the cylinder port 22 is sealed by the top dead center-side sealing surface 63.

However, when the cylinder port 22 is positioned between the suction port 61 and the delivery port 62, the cylinder port 22 need not be entirely sealed by the bottom dead center-side sealing surface 64 or the top dead center-side sealing surface 63, but may instantaneously communicate with both the suction port 61 and the delivery port 62.

Hereinafter, for the sake of convenience of the description, a direction connecting between the top dead center and the bottom dead center is referred to as the vertical direction, and a direction orthogonal to the vertical direction and the forward-backward direction is referred to as the left-right direction. That is, the suction port 61 and the delivery port 62 are spaced apart from each other in the left-right direction.

The swash plate 5 includes a sliding surface parallel to the left-right direction. When seen in the left-right direction, the sliding surface of the swash plate 5 is tilted toward the top dead center-side sealing surface 63 of the valve plate 6, but is tilted away from the bottom dead center-side sealing surface 64 of the valve plate 6. The swash plate 5 is supported by an unshown support on the casing 15.

A shoe 4, which slides on the sliding surface of the swash plate 5, is mounted to the distal end of each of the above-described pistons 3. The shoe 4 is held down by an unshown holder, such that the shoe 4 is kept in contact with the sliding surface of the swash plate 5. There may be a shoe plate located between the swash plate 5 and the shoe 4.

The valve cover 7 includes a suction passage 71 and a delivery passage 72. The suction passage 71 communicates with the suction port 61 of the valve plate 6, and the delivery passage 72 communicates with the delivery port 62 of the valve plate 6. In the present embodiment, the suction passage 71 and the delivery passage 72 are open in the respective side surfaces of the valve cover 7. In the illustrated example, each of the suction passage 71 and the delivery passage 72 extends backward from the front surface of the valve cover 7, and then bends by 90 degrees. The valve cover 7 further includes a recess 75 on its front surface. The recess 75 is located between the suction passage 71 and the delivery passage 72. The bearing 13 is fitted in the recess 75.

The valve cover 7 further includes a first chamber 8 and a second chamber 9. In the present embodiment, the first chamber 8 and the second chamber 9 are located between the suction passage 71 and the delivery passage 72. That is, a space between the suction passage 71 and the delivery passage 72, the space having a trapezoidal sectional shape, is utilized for the formation of the first chamber 8 and the second chamber 9.

In the present embodiment, each of the first chamber 8 and the second chamber 9 has a vertically-extending rectangular parallelepiped shape with round corners. However, the shape of each of the first chamber 8 and the second chamber 9 is not limited to this example, but may be changed as necessary.

In the present embodiment, the volume of the second chamber 9 is less than the volume of the first chamber 8. Alternatively, the volume of the second chamber 9 may be the same as, or greater than, the volume of the first chamber 8.

When seen in the forward-backward direction, the second chamber 9 extends in the vertical direction in a manner to straddle the bottom dead center-side sealing surface 64 and the top dead center-side sealing surface 63. In other words, when seen in the forward-backward direction, the second chamber 9 overlaps the bottom dead center-side sealing surface 64 and the top dead center-side sealing surface 63. Alternatively, when seen in the forward-backward direction, the second chamber 9 may overlap only the bottom dead center-side sealing surface 64.

In the present embodiment, the first chamber 8 is greater than the second chamber 9 in terms of all of the following dimensions: the length in the vertical direction, the width in the left-right direction; and the depth in the forward-backward direction. That is, similar to the second chamber 9, the first chamber 8 also straddles the bottom dead center-side sealing surface 64 and the top dead center-side sealing surface 63 when seen in the forward-backward direction. However, one of the length, the width, or the depth of the first chamber 8 may be less than that of the second chamber 9.

In the present embodiment, the length of the second chamber 9 is greater than the diameter of the recess 75. Accordingly, the middle portion of the second chamber 9 and the middle portion of the first chamber 8 are positioned within a region that is surrounded by the recess 75, the suction passage 71, and the delivery passage 72. Alternatively, the length of the second chamber 9 may be set to be less than the diameter of the recess 75, and the entire second chamber 9 may be positioned within the region that is surrounded by the recess 75, the suction passage 71, and the delivery passage 72. Similarly, the length of the first chamber 8 may be set to be less than the diameter of the recess 75, and the entire first chamber 8 may be positioned within the region that is surrounded by the recess 75, the suction passage 71, and the delivery passage 72.

The first chamber 8 and the second chamber 9 are located side by side in the forward-backward direction. In other words, when seen in the forward-backward direction, the first chamber 8 and the second chamber 9 overlap. To be more specific, the second chamber 9 having a less volume is positioned forward, and the first chamber 8 having a greater volume is positioned backward. In other words, the second chamber 9 is positioned between the first chamber 8 and the valve plate 6. Alternatively, the first chamber 8 and the second chamber 9 may be located side by side in the left-right direction, or located side by side in the vertical direction. If the first chamber 8 and the second chamber 9 are located side by side in the forward-backward direction, then in a case where an introduction passage 91 and a supply passage 93, which will be described below, are positioned coaxially, the introduction passage 91 and the supply passage 93 can be machined at the same time.

The first chamber 8 communicates with the delivery passage 72. The valve cover 7 includes a communication passage 81, which allows the first chamber 8 to communicates with the delivery passage 72. In the present embodiment, the communication passage 81 extends in the left-right direction such that the communication passage 81 is open on a curved surface of the delivery passage 72. According to this configuration, through the downstream-side opening of the delivery passage 72, the communication passage 81 can be machined, for example, by using a drill. However, the orientation and the position of the communication passage 81 are not particularly limited.

The first chamber 8 functions as a Helmholtz resonator. That is, the diameter and the length of the communication passage 81 as well as the volume of the first chamber 8 are designed so as to achieve a predetermined resonance frequency.

Desirably, the communication passage 81 is a linear passage. The reason for this is that if the communication passage 81 is a curved passage, the resonance effect is reduced. Desirably, the communication passage 81 has a relatively large cross-sectional area.

The first chamber 8 needs to have a relatively large volume for direct damping of delivery pressure. For example, desirably, the length of the first chamber 8 in the vertical direction is greater than the diameter of an inscribed circle of the suction port 61 and the delivery port 62 of the valve plate 6 (i.e., a circle that passes through the inner arc of the suction port 61 and the inner arc of the delivery port 62) such that, as previously described, when seen in the forward-backward direction, the first chamber 8 straddles the bottom dead center-side sealing surface 64 and the top dead center-side sealing surface 63. More desirably, the length of the first chamber 8 in the vertical direction is greater than the diameter of a circle that passes through the center of the suction port 61 and the center of the delivery port 62 of the valve plate 6 (i.e., greater than the average value of the diameter of the inscribed circle of the suction port 61 and the delivery port 62 and the diameter of the circumscribed circle of the suction port 61 and the delivery port 62). Yet more desirably, the length of the first chamber 8 in the vertical direction is greater than the external diameter of the valve plate 6.

In the present embodiment, the second chamber 9 communicates with the first chamber 8. The valve cover 7 includes the aforementioned introduction passage 91, which allows the second chamber 9 to communicate with the first chamber 8. In the present embodiment, the introduction passage 91 extends in the forward-backward direction. However, the orientation of the introduction passage 91 is not particularly limited. The position of the introduction passage 91 is also not particularly limited.

In the present embodiment, a part of the introduction passage 91 functions as a restrictor 92. The restrictor 92 may be an orifice, or may be a choke. In a case where the restrictor 92 is a choke, the introduction passage 91 over its entire length may function as the restrictor 92.

Further, in the valve cover 7 and the valve plate 6, the aforementioned supply passage 93 extends from the second chamber 9 to the bottom dead center-side sealing surface 64. In the present embodiment, the supply passage 93 extends in the forward-backward direction. However, the orientation of the supply passage 93 is not particularly limited. The position of the supply passage 93 is also not particularly limited.

In the present embodiment, a part of the supply passage 93 functions as a restrictor 94. The restrictor 94 may be an orifice, or may be a choke. The restrictor 94 may be located either in the valve cover 7 or in the valve plate 6. Alternatively, in a case where the restrictor 94 is a choke, the supply passage 93 over its entire length may function as a restrictor.

The second chamber 9 functions as an accumulator that accumulates delivery pressure, and supplies the accumulated delivery pressure to the cylinder bore 21 near the bottom dead center through the supply passage 93. The volume of the second chamber 9 is such a volume as to enable delivery of the hydraulic liquid to the cylinder bore 21.

The restrictor 92 is intended for restricting the amount of hydraulic liquid flowing into the second chamber 9 and variation in the amount of hydraulic liquid flowing into the second chamber 9. In light of this, desirably, the cross-sectional area of the restrictor 92 (the minimum cross-sectional area of the introduction passage 91) is relatively small. On the other hand, the restrictor 94 is intended for restricting the amount of hydraulic liquid flowing out of the second chamber 9. In light of this, the cross-sectional area of the restrictor 94 (the minimum cross-sectional area of the supply passage 93) need not be so small. For example, the cross-sectional area of the restrictor 94 is greater than the cross-sectional area of the restrictor 92.

When one of the cylinder bores 21 comes into communication with the supply passage 93 through the cylinder port 22 near the bottom dead center in accordance with rotation of the cylinder block 2, the hydraulic liquid is supplied from the second chamber 9 to the one cylinder bore 21 through the supply passage 93. At the time, owing to the restrictor 94, a suitable amount of hydraulic liquid is supplied. Meanwhile, although pressure variation occurs in the second chamber 9 as a result of the hydraulic liquid flowing out of the second chamber 9, the restrictor 92 hinders the pressure variation from being transmitted through the first chamber 8 to the delivery passage 72.

In the hydraulic pump 1 configured as described above, delivery pressure is introduced into the second chamber 9 in the valve cover 7 through the communication passage 81, the first chamber 8, and the introduction passage 91. Since the supply passage 93 extends from the second chamber 9 to the bottom dead center-side sealing surface 64, the delivery pressure can be introduced into the cylinder bore 21 near the bottom dead center. By the second chamber 9 thus configured, pulsation of delivery pressure at relatively low frequencies can be reduced. Moreover, since the valve cover 7 includes the first chamber 8, which functions as a Helmholtz resonator, pulsation of delivery pressure at relatively high frequencies can be reduced by the first chamber 8. Consequently, pulsation of delivery pressure can be reduced over a wide rotation speed range.

Furthermore, in the present embodiment, since the volume of the second chamber 9 is less than the volume of the first chamber 8, the size of the first chamber 8 and the size of the second chamber 9 in relation to each other can be set in accordance with their respective necessary volumes. This makes it possible to prevent an increase in the size of the valve cover 7 (the hydraulic pump 1).

Incidentally, in the hydraulic pump disclosed by Patent Literature 1, the hydraulic liquid flows through the first communication passage intermittently, which may adversely facilitate pulsation of delivery pressure. In this respect, in the hydraulic pump 1 of the present embodiment, the first chamber 8 is always in communication with the delivery passage 72 through the communication passage 81, and the second chamber 9 is always in communication with the delivery passage 72 through the introduction passage 91, the first chamber 8, and the communication passage 81. Therefore, the above problem that may occur in the hydraulic pump of Patent Literature 1 does not occur in the hydraulic pump 1 of the present embodiment.

Further, in the present embodiment, when seen in the forward-backward direction, the second chamber 9 overlaps the bottom dead center-side sealing surface 64 and the top dead center-side sealing surface 63. Accordingly, the supply passage 93 can be made parallel to the axial direction of the rotational shaft 11. In addition, regardless of whether the rotation direction of the rotational shaft 11 is the clockwise direction or the counterclockwise direction, either case can be accommodated by merely changing the position of the supply passage 93.

For example, in the present embodiment, since the rotation direction of the rotational shaft 11 is the clockwise direction in FIG. 2, the lower sealing surface is the bottom dead center-side sealing surface. Contrary to the present embodiment, in a case where the rotation direction of the rotational shaft 11 is the counterclockwise direction in FIG. 2, the upper sealing surface is the bottom dead center-side sealing surface (in this case, the tilting direction of the swash plate 5 is also opposite the tilting direction shown in FIG. 1). In this case, it will suffice if the position of the supply passage 93 is merely changed from the lower side to the upper side in FIG. 2.

(Variations)

The present disclosure is not limited to the above-described embodiment. Various modifications can be made without departing from the scope of the present disclosure.

For example, although not illustrated, the suction passage 71 and the delivery passage 72 in the valve cover 7 may extend substantially linearly from the suction port 61 and the delivery port 62, such that the suction passage 71 and the delivery passage 72 are open at the back surface of the valve cover 7. In this case, the first chamber 8 and the second chamber 9 in the valve cover 7 may be located outside the suction passage 71 and the delivery passage 72, such that the suction passage 71 and the delivery passage 72 are located between the first chamber 8 and the second chamber 9. Alternatively, either one of the suction passage 71 or the delivery passage 72 may bend by 90 degrees similar to the above-described embodiment, and the other passage may be a substantially linear passage.

However, if the first chamber 8 and the second chamber 9 are located between the suction passage 71 and the delivery passage 72 as in the above-described embodiment, the space between the suction passage 71 and the delivery passage 72 can be utilized for the formation of the first chamber 8 and the second chamber 9.

Figure 4:
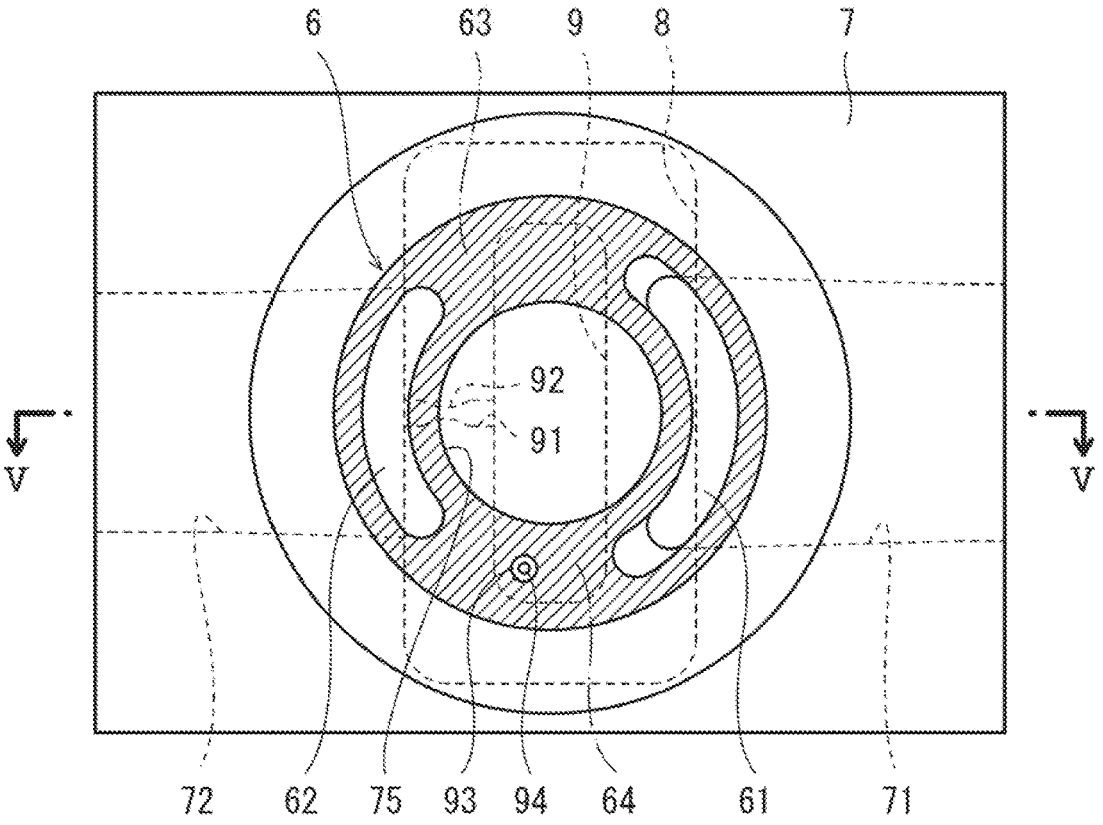
FIG. 4 is a cross-sectional view of a hydraulic pump according to a variation.
Figure 5:
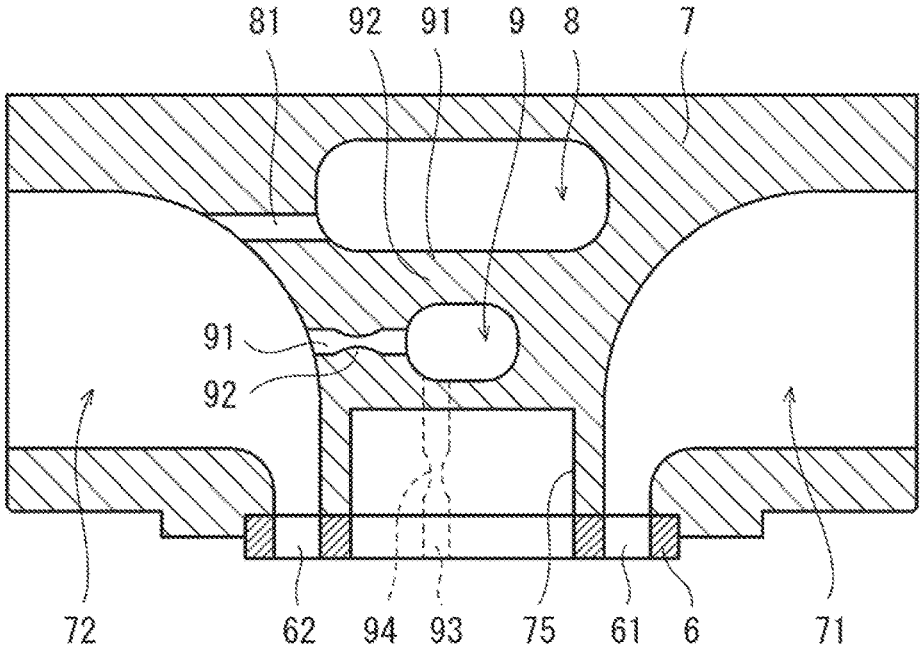
FIG. 5 is a sectional plan view taken along line V-V of FIG. 4.

The second chamber 9 need not communicate with the first chamber 8 through the introduction passage 91. Alternatively, for example, as shown in FIG. 4 and FIG. 5, the second chamber 9 may communicate with the delivery passage 72 through the introduction passage 91.

In the above-described embodiment, the valve cover 7 is a single component. Alternatively, the valve cover 7 may include: a valve cover body including the suction passage 71 and the delivery passage 72; and an attachment mounted to the valve cover body. In this case, the attachment may include one of, or both, the first chamber 8 and the second chamber 9. However, if the valve cover 7 is a single component as in the above-described embodiment, the hydraulic pump 1 can be reduced in size.

The hydraulic pump 1 may be a tandem pump in which the rotational shaft 11 penetrates the valve cover 7, and cylinder blocks 2 are located on both sides of the valve cover 7, respectively. In this case, each of the first chamber 8 and the second chamber 9 may be shaped (e.g., arc-shaped)

along the outer peripheral surface of the rotational shaft 11. In a case where the hydraulic pump 1 is a tandem pump, since the valve cover 7 includes two sets of the suction passage 71 and the delivery passage 72, there may also be two sets of the first chamber 8 and the second chamber 9. Alternatively, the hydraulic pump 1 may be a parallel pump in which two cylinder blocks 2 are located parallel to each other in a space that is surrounded by the casing 15 and the valve cover 7.

Further, it is not essential that at least a part of the introduction passage 91 function as a restrictor. However, if at least a part of the introduction passage 91 functions as the restrictor 92 as in the above-described embodiment, the amount of hydraulic liquid flowing into the second chamber 9 and variation in the amount of hydraulic liquid flowing into the second chamber 9 can be restricted by the restrictor 92. The restriction of the amount of hydraulic liquid flowing into the second chamber 9 by the restrictor 92 makes it possible to maintain the function of the pump. Further, the restrictor 92 also serves to hinder pressure variation in the second chamber 9 from being transmitted to the delivery passage 72.

It is not essential that at least a part of the supply passage 93 function as a restrictor. However, if at least a part of the supply passage 93 functions as the restrictor 94 as in the above-described embodiment, the amount of hydraulic liquid flowing out of the second chamber 9 can be restricted by the restrictor 94. In a case where the introduction passage 91, even a part thereof, does not function as a restrictor, the function of the pump can be maintained by the restrictor 94.

SUMMARY

A hydraulic piston according to the present disclosure includes: a valve plate including a suction port and a delivery port; a valve cover to which the valve plate is mounted, the valve cover including a suction passage that communicates with the suction port and a delivery passage that communicates with the delivery port; and a cylinder block that slides on the valve plate, the cylinder block including cylinder bores that receive therein respective pistons. The valve cover includes: a first chamber that communicates with the delivery passage through a communication passage and functions as a Helmholtz resonator; and a second chamber that communicates with the delivery passage, or with the first chamber, through an introduction passage. In the valve cover and the valve plate, a supply passage extends from the second chamber to a bottom dead center-side sealing surface of the valve plate, the bottom dead center-side sealing surface being a surface located between the suction port and the delivery port.

According to the above configuration, delivery pressure is introduced into the second chamber in the valve cover through the introduction passage. Since the supply passage extends from the second chamber to the bottom dead center-side sealing surface, the delivery pressure can be introduced into the cylinder bore near the bottom dead center. By the second chamber thus configured, pulsation of delivery pressure at relatively low frequencies can be reduced. Moreover, since the valve cover includes the first chamber that functions as a Helmholtz resonator, pulsation of delivery pressure at relatively high frequencies can be reduced by the first chamber. Consequently, pulsation of delivery pressure can be reduced over a wide rotation speed range.

At least a part of the introduction passage may function as a restrictor. According to this configuration, the amount of hydraulic liquid flowing into the second chamber and variation in the amount of hydraulic liquid flowing into the second chamber can be restricted by the restrictor of the introduction passage. The restriction of the amount of hydraulic liquid flowing into the second chamber by the restrictor makes it possible to maintain the function of the pump.

At least a part of the supply passage may function as a restrictor. According to this configuration, the amount of hydraulic liquid flowing out of the second chamber can be restricted by the restrictor of the supply passage.

The first chamber and the second chamber may be located between the suction passage and the delivery passage. According to this configuration, a space between the suction passage and the delivery passage can be utilized for the formation of the first chamber and the second chamber.

For example, the valve cover may include a recess in which a bearing is fitted, the bearing rotatably supporting a rotational shaft that penetrates the cylinder block, and at least a part of the first chamber and at least a part of the second chamber may be positioned within a region that is surrounded by the recess, the suction passage, and the delivery passage.

The first chamber and the second chamber may be located side by side in an axial direction of a rotational shaft that penetrates the cylinder block. According to this configuration, in a case where the second chamber communicates with the first chamber through the introduction passage and the introduction passage and the supply passage are positioned coaxially, the introduction passage and the supply passage can be machined at the same time.

For example, the second chamber may be positioned between the valve plate and the first chamber.

The above hydraulic pump may further include a rotational shaft that penetrates the cylinder block. When seen in an axial direction of the rotational shaft, the second chamber may extend in a manner to straddle the bottom dead center-side sealing surface and a top dead center-side sealing surface of the valve plate, the top dead center-side sealing surface being a surface located between the suction port and the delivery port. According to this configuration, the supply passage can be made parallel to the axial direction of the rotational shaft. In addition, regardless of whether the rotation direction of the rotational shaft is the clockwise direction or the counterclockwise direction, either case can be accommodated by merely changing the position of the supply passage.

A volume of the second chamber may be less than a volume of the first chamber. According to this configuration, the size of the first chamber and the size of the second chamber in relation to each other can be set in accordance with their respective necessary volumes. This makes it possible to prevent an increase in the size of the valve cover (the hydraulic pump).

The invention claimed is:

1. A hydraulic pump comprising:

a valve plate including a suction port and a delivery port;

a valve cover to which the valve plate is mounted, the valve cover including a suction passage that communicates with the suction port and a delivery passage that communicates with the delivery port; and a cylinder block that slides on the valve plate, the cylinder block including cylinder bores that receive therein respective pistons, wherein the valve cover includes:

a first chamber that communicates with the delivery passage through a communication passage and functions as a Helmholtz resonator; and a second chamber that communicates with the delivery passage, or with the first chamber, through an introduction passage, and in the valve cover and the valve plate, a supply passage extends from the second chamber to a bottom dead center-side sealing surface of the valve plate, the bottom dead center-side sealing surface being a surface located between the suction port and the delivery port.

2. The hydraulic pump according to claim 1, wherein at least a part of the introduction passage functions as a restrictor.

3. The hydraulic pump according to claim 1, wherein at least a part of the supply passage functions as a restrictor.

4. The hydraulic pump according to claim 1, wherein the first chamber and the second chamber are located between the suction passage and the delivery passage.

5. The hydraulic pump according to claim 4, wherein the valve cover includes a recess in which a bearing is fitted, the bearing rotatably supporting a rotational shaft that penetrates the cylinder block, and at least a part of the first chamber and at least a part of the second chamber are positioned within a region that is surrounded by the recess, the suction passage, and the delivery passage.

6. The hydraulic pump according to claim 1, wherein the first chamber and the second chamber are located side by side in an axial direction of a rotational shaft that penetrates the cylinder block.

7. The hydraulic pump according to claim 6, wherein the second chamber is positioned between the valve plate and the first chamber.

8. The hydraulic pump according to claim 1, further comprising a rotational shaft that penetrates the cylinder block, wherein when seen in an axial direction of the rotational shaft, the second chamber extends in a manner to straddle the bottom dead center-side sealing surface and a top dead center-side sealing surface of the valve plate, the top dead center-side sealing surface being a surface located between the suction port and the delivery port.

9. The hydraulic pump according to claim 1, wherein a volume of the second chamber is less than a volume of the first chamber.

* * * * *